US008971153B2

(12) United States Patent
Takenawa

(10) Patent No.: US 8,971,153 B2
(45) Date of Patent: Mar. 3, 2015

(54) INFORMATION DISPLAY DEVICE AND ANALOG ELECTRONIC TIMEPIECE

(71) Applicant: Casio Computer Co., Ltd., Tokyo (JP)

(72) Inventor: Hideo Takenawa, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/937,621

(22) Filed: Jul. 9, 2013

(65) Prior Publication Data

US 2014/0036640 A1 Feb. 6, 2014

(30) Foreign Application Priority Data

Jul. 31, 2012 (JP) ..... 2012-169209

(51) Int. Cl.
*G04B 19/20* (2006.01)
*G04C 17/00* (2006.01)

(52) U.S. Cl.
CPC ..... *G04C 17/0058* (2013.01)
USPC ..... 368/37; 368/35

(58) Field of Classification Search
USPC ..... 368/28, 35, 37, 77, 233; 40/107, 111, 40/115
See application file for complete search history.

(56) References Cited

U.S. PATENT DOCUMENTS 2,286,000 A * 6/1942 Neyhart ..... 368/35
3,518,825 A * 7/1970 Nissen ..... 368/37
3,702,530 A * 11/1972 Besson et al. ..... 368/35
3,827,231 A * 8/1974 Foerster ..... 368/37
3,879,929 A * 4/1975 Charbonney et al. ..... 368/38
4,422,775 A * 12/1983 Thoenig ..... 368/74
5,181,190 A * 1/1993 Kanzaki ..... 368/76
5,289,437 A * 2/1994 Leuenberger et al. ..... 368/37
5,724,318 A * 3/1998 Mossuz ..... 368/37
6,925,032 B2 * 8/2005 Willemin et al. ..... 368/28
7,859,949 B2 * 12/2010 Kitahara et al. ..... 368/37
7,859,950 B2 * 12/2010 Calabrese ..... 368/37
7,898,906 B2 * 3/2011 Ishihara et al. ..... 368/113

FOREIGN PATENT DOCUMENTS

JP 06-66963 A 3/1994

* cited by examiner

*Primary Examiner* — Amy Cohen Johnson
*Assistant Examiner* — Jason Collins
(74) *Attorney, Agent, or Firm* — Holtz, Holtz, Goodman & Chick PC

(57) ABSTRACT

An information display device includes a dial plate having a display window; a rotatable date display plate provided under the dial plate and having dates to be selectively displayed through the window; an information display plate provided between the dial plate and the date display plate and including a display portion having an information item on a top surface thereof; an information display plate driver capable of moving the information display plate to any one of first and second positions. When the information display plate is in the first position, the display portion does not lie just under the window and a date in a position corresponding to the window is displayed through the window. When the information display plate is in the second position, the display portion is in a position corresponding to the window.

7 Claims, 11 Drawing Sheets

RECEIVING PROCESS
S201
IS DATA RECEIVED?
NO
YES
S202
INCOMING SIGNAL?
NO
YES
S211
INCOMING CALL SIGNAL?
NO
YES
S212
FT ← 1
S213
DISPLAY "TEL"
S222
FM ← 1
S223
DISPLAY "MAIL"
S203
CONFIRMATION SIGNAL?
NO
YES
S231
CALL CONFIRMATION SIGNAL?
NO
YES
S232
FT ← 0
S242
FM ← 0
S233
FM = 1?
NO
YES
S243
FT = 1?
NO
YES
S234
DISPLAY "MAIL"
S254
DISPLAY DATE
S244
DISPLAY "TEL"
S204
OTHER PROCESSES
RETURN

INFORMATION DISPLAY DEVICE AND ANALOG ELECTRONIC TIMEPIECE

BACKGROUND OF THE INVENTION

1. Field of the Invention

The present invention relates to an analog information display device and an analog electronic timepiece.

2. Description of the Related Art

A conventional display device is described, for example, in Japanese Patent Laid-Open No. 6-66963. This device can display various information items by means of combination of signs provided on a dial plate and rotatable hands.

Display of multiple information items on a display device is achieved by selectively displaying signs and marks provided on the dial plate in association with the respective information items, or by providing hands corresponding to the respective information items.

Unfortunately, a larger number of information items to be displayed cause an increase in the number of marks to be indicated on the dial plate, resulting in increased design constraints and difficulty for the user in identifying which mark is indicated.

To address this, another conventional technique has been used that provides a rotatable information display plate (rotary disk) under the dial plate and selectively exposes any one of the signs on the rotary disk through an aperture provided in the dial plate. This technique can allow unnecessary information to remain hidden.

Nevertheless, when a single rotary disk is rotated with a step motor to display multiple information items selectively, it takes time to display a particular information item owing to limitations of rotation speed.

SUMMARY OF THE INVENTION

An object of the present invention is to provide an information display device and an analog electronic timepiece that allow for quick switching among, displayed information items without compromising readability.

According to a first aspect of the present invention, there is provided an information display device including: a dial plate having a display window; a rotatable date display plate provided under the dial plate, the date display plate having a plurality of dates to be selectively displayed through the display window; an information display plate provided between the dial plate and the date display plate, the information display plate including an information display portion having an information item on a top surface thereof, the information item being different from the dates; and an information display plate driver capable of moving the information display plate to any one of a predetermined first position and a second position, wherein, when the information display plate is in the first position, the information display portion does not lie just under the display window and a date of the dates in a position corresponding to the display window is displayed through the display window; and when the information display plate is in the second position, the information display portion is in a position corresponding to the display window.

According to a second aspect of the present invention, there is provided an information display device including: a dial plate having a display window; a rotatable first information display plate provided under the dial plate, the first information display plate having a plurality of first information items to be selectively displayed through the display window; a motor which intermittently rotates the first information display plate; a rotatable second information display plate provided between the dial plate and the first information display plate, the second information display plate including a second information display portion having a second information item on a top surface thereof; and an information display plate driver which rotates the second information display plate above the first information display plate with the motor while the first information display plate is standing still, so that the second information display portion is moved to a position corresponding to the display window.

According to a third aspect of the present invention, there is provided an information display device including: a dial plate having a display window; a rotatable first information display plate provided under the dial plate, the first information display plate having a plurality of first information items to be selectively displayed through the display window; a second information display plate provided between the dial plate and the first information display plate, the second information display plate including a second information display portion having a second information item on a top surface thereof; and an information display plate driver capable of moving the second information display plate to any one of a predetermined first position and a second position, wherein, when the second information display plate is in the first position, the second information display portion does not lie just under the display window and a first information item of the first information items in a position corresponding to the display window is displayed through the display window; and when the second information display plate is in the second position, the second information display portion is in a position corresponding to the display window.

BRIEF DESCRIPTION OF THE DRAWING

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

Embodiments of the present invention will be described below with reference to the accompanying drawings.

Figure 1:
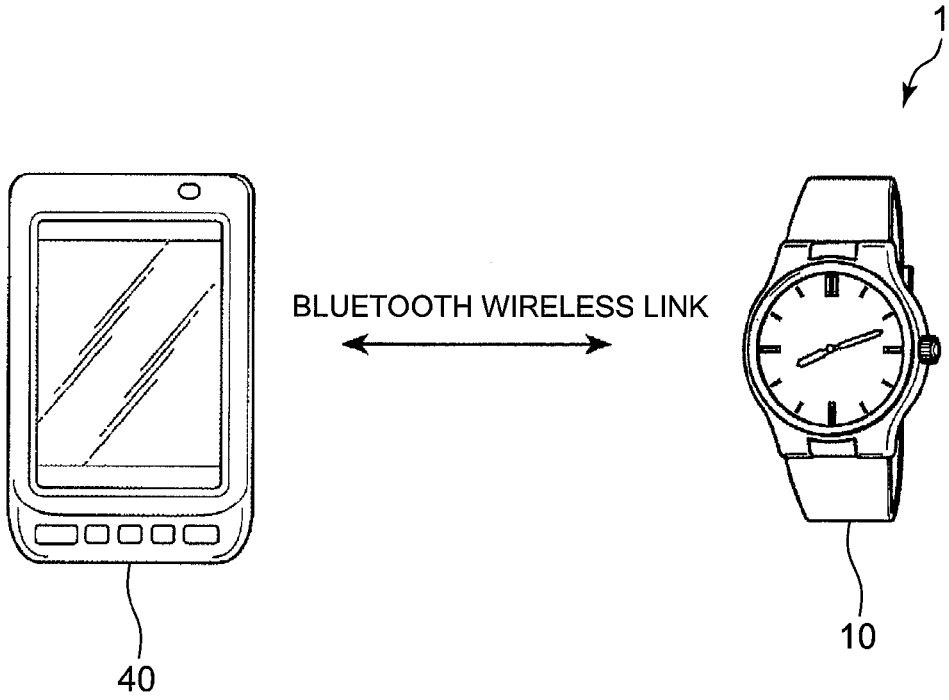
FIG. 1 is an entire view of an information display system including an analog electronic timepiece according to an embodiment of the present invention.

FIG. 1 illustrates an information display system 1 including an analog electronic timepiece 10, which is an embodiment of an information display device according to the present invention.

The information display system 1 of the present embodiment includes the analog electronic timepiece 10 and a smartphone 40, which is an external device.

The analog electronic timepiece 10 and the smartphone 40 can communicate with each other through near field communication.

Non-limiting examples of the near field communication include a Bluetooth (registered trademark) scheme.

The analog electronic timepiece 10 receives a notice of an incoming call or e-mail to the smartphone 40 and a notice that the call or e-mail has been checked in substantially real time through the near field communication from the smartphone 40 and then makes notification.

Figure 2A:
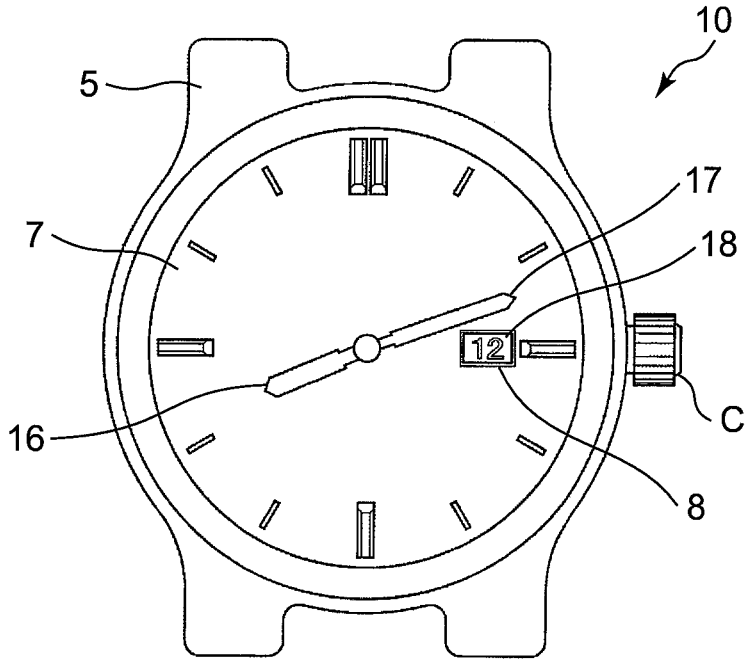
FIGS. 2A and 2B are front views of the analog electronic timepiece.
Figure 2B:
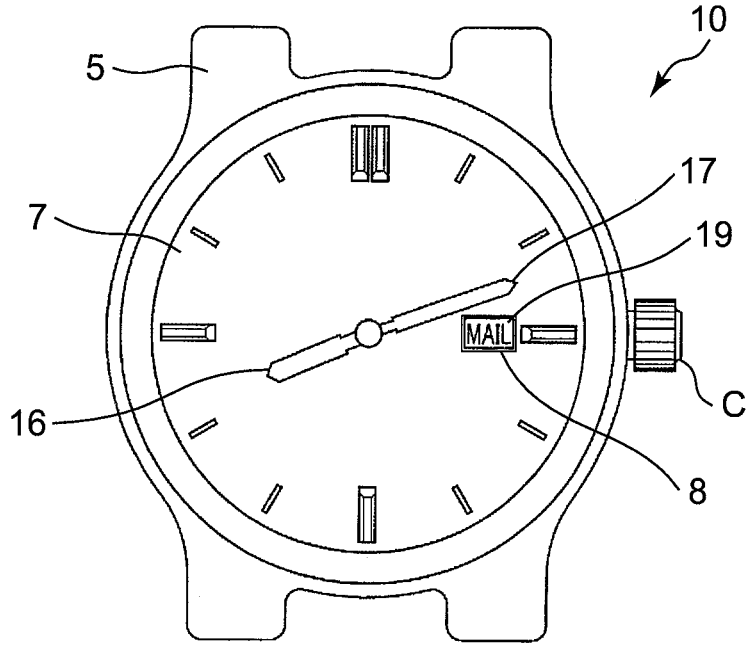

FIGS. 2A and 2B are front views of the analog electronic timepiece 10.

The analog electronic timepiece 10 includes a casing 5 that covers the both sides and bottom, a dial plate 7 (first information display plate), an hour hand 16, and a minute hand 17. The hour hand 16 and the minute hand 17 (i.e., a plurality of hands), which can rotate about a single rotation axis, are provided between the dial plate 7 and a timepiece crystal (not shown) that covers the front face.

A date indicator 18 (date display plate or first information display plate) and an information display plate 19 (second information display plate) both lie under the dial plate 7.

The dial plate 7, at its three o'clock position, has an aperture 8 (display window) through which any one of the signs on the date indicator 18 and on the information display plate 19 can be selectively displayed, as illustrated in FIGS. 2A and 2B.

The casing 5 includes a crown C, which can be turned by a user, at its one side.

The dial plate 7 has hour marks on its periphery. The hour marks are signs of one through twelve o'clock and arranged every 30 degrees.

Figure 3:
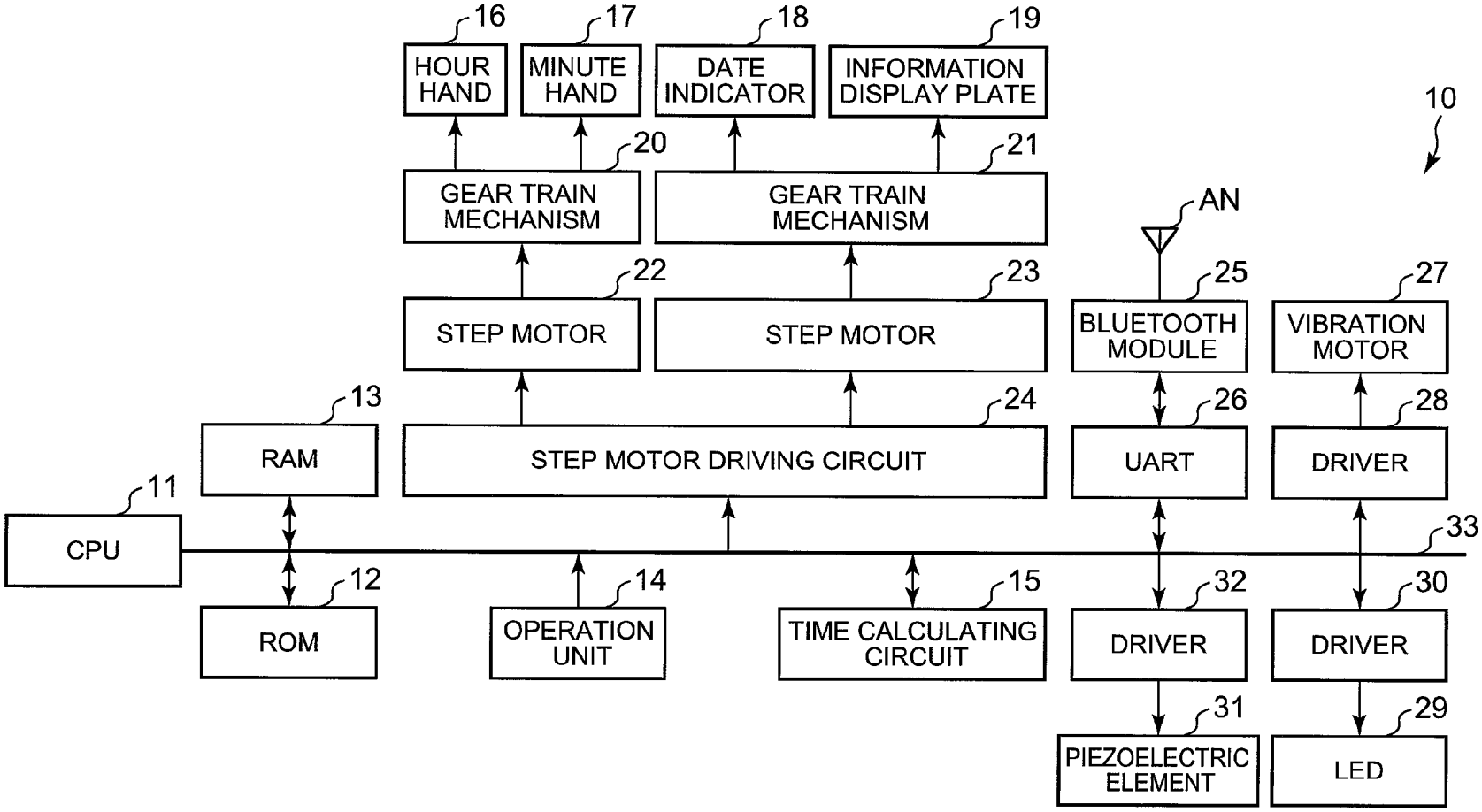
FIG. 3 is a block diagram illustrating the internal configuration of the analog electronic timepiece.

FIG. 3 is a block diagram illustrating the internal configuration of the analog electronic timepiece 10.

The analog electronic timepiece 10 includes a central processing unit (CPU) 11 (information display plate drive controller and illumination controller), read only memory (ROM) 12, random access memory (RAM) 13, an operation unit 14, a time calculating circuit 15 (time calculating unit), a step motor 22 which rotates the hour hand 16 and the minute hand 17 in an interlocked manner through a gear train mechanism 20, a step motor 23 (motor) which rotates the date indicator 18 and the information display plate 19 in an interlocked manner through a gear train mechanism 21, a step motor driving circuit 24 (information display plate driver) which performs step drive of the step motors 22 and 23, an antenna AN, a Bluetooth module (wireless communication unit), a universal asynchronous receiver transmitter (UART) 26, a vibration motor 27, a driver 28 for the vibration motor 27, a light emitting diode (LED) 29, a driver 30 for the LED 29, a piezoelectric element 31, a driver 32 for the piezoelectric element 31, and a bus 33 which allows signals to travel between a CPU 11 and each of the above components.

The CPU 11 controls the overall operation of the analog electronic timepiece 10 and executes various arithmetic processes.

The CPU 11 sends a control signal to the step motor driving circuit 24 on the basis of the current time calculated by the time calculating circuit 15, thereby driving the step motor 22 to display the time by the hour hand 16 and the minute hand 17.

The CPU 11 also allows the step motor 23 to be driven to display a date by the date indicator 18.

The CPU 11 determines the item to be displayed, on the basis of incoming information received from the smartphone 40 via the Bluetooth module 25.

The CPU 11 allows the step motor driving circuit 24 to drive the step motor 23 in accordance with the item to be displayed, which then rotates the information display plate 19 to display the item.

The ROM 12 stores a variety of programs to be executed by the CPU 11 and default data therein.

The programs stored in the ROM 12 include a program for controlling Bluetooth communications with the smartphone 40.

The RAM 13 provides the CPU 11 with a working memory space to store temporary data.

The RAM 13 also stores flags FT and FM in a binary format that respectively indicate the reception of an incoming call signal and an incoming e-mail signal, described later.

The operation unit 14 includes the crown C and converts the operations of pulling, pushing, and turning the crown C into their respective electrical signals, which are then sent to the CPU 11 as input signals.

The time calculating circuit 15 is a counter which calculates and keeps the current time on the basis of input clock signals that have a predetermined frequency.

This current time is read out and indicated by the hour hand 16 and the minute hand 17. In addition, a variety of operations are performed as a result of comparison between the current time data and the set time data associated with various functions.

The step motor driving circuit 24 receives a control signal including a command for driving the step motors 22 and 23 from the CPU 11 and then transmits pulses for individually driving each of the step motors 22 and 23.

Each of the step motors 22 and 23 is step-driven by the drive pulses from the step motor driving circuit 24 and rotates in a forward or reverse direction by a predetermined angle (e.g., 180 degrees) in response to a voltage wave form of the drive pulses.

The gear train mechanisms 20 and 21 are each composed of multiple gear trains.

The gear train mechanism 20 adjusts the rotation angle of the step motor 22 in accordance with the gear ratio to rotate the minute hand 17 by a predetermined angle (here, one degree) per step of the step motor 22.

The hour hand 16 rotates in conjunction with the minute hand 17. The gear train mechanism 21 adjusts the rotation angle of the step motor 23 in accordance with the gear ratio to rotate the information display plate 19 by a predetermined angle.

When the information display plate 19 rotates within a certain angular range (i.e., a predetermined part of the rotation of the information display plate 19), the gear train mechanism 21 also rotates the date indicator 18 in an interlocked manner.

The structure of the gear train mechanism 21 will be described in detail later.

The Bluetooth module 25 is a control module that provides Bluetooth communications with an external device via the antenna AN.

Data transmitted from the CPU 11 is serial- or parallel-converted by the UART 26 and is then transmitted from the Bluetooth module 25 to an external device such as the smartphone 40.

Data received from the external device via the antenna AN and the Bluetooth module 25 is serial- or parallel-converted by the UART 26 and is then output to the CPU 11.

The data received by the analog electronic timepiece 10 from the smartphone 40 includes control data and predetermined data.

This received data includes an incoming signal indicating the reception of predetermined information by the smartphone 40 and a confirmation signal indicating that the received predetermined information has been confirmed.

The analog electronic timepiece 10 of the present embodiment is configured to receive incoming and confirmation signals of a call and an e-mail to the smartphone 40.

The call confirmation signal indicates the completion of a response to or caller ID confirmation for every incoming call associated with incoming call signals transmitted from the smartphone 40.

The e-mail confirmation signal indicates the completion of check of or sender address confirmation for every incoming e-mail associated with incoming e-mail signals transmitted from the smartphone 40.

The vibration motor 27, the LED 29, and the piezoelectric element (e.g., PZT) 31 make notification to the user by vibrations, light, and a beep, respectively.

When the drivers 28, 30 and 32 receive control signals from the CPU 11, the drivers 28, 30 and 32 convert the received signals into voltage signals for operating the vibration motor 27, the LED 29, and the piezoelectric element 31, respectively, and output the resultant signals.

These operations may be used for alarm notification of a set time in the analog electronic timepiece 10 and may also be performed for notification of incoming signal reception.

The rotational mechanism of the date indicator 18 and the information display plate 19 in the analog electronic timepiece 10 of the present embodiment will now be described.

Figure 4A:
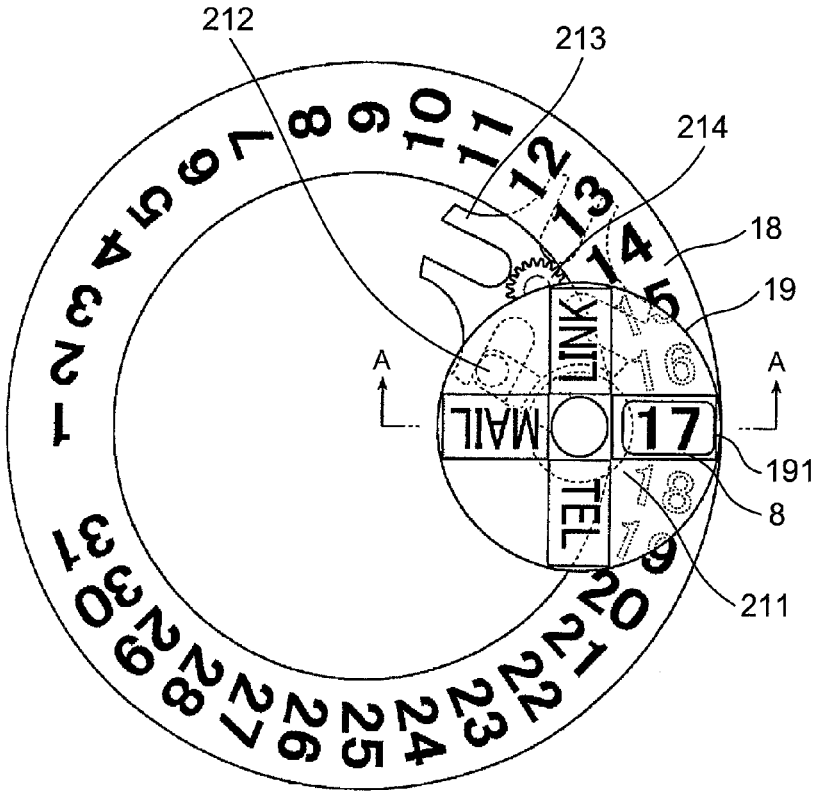
FIGS. 4A and 4B illustrate the configuration of a date indicator and an information display plate.
Figure 4B:
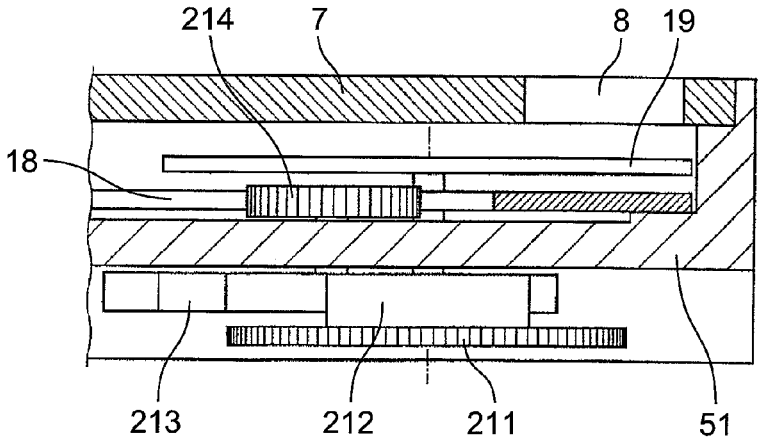

FIGS. 4A and 4B illustrate the date indicator 18 and the information display plate 19 in the analog electronic timepiece 10 of the present embodiment.

FIG. 4A is a schematic top view of the configuration of the date indicator 18 and the information display plate 19.

FIG. 4B is a schematic side view of this configuration taken along line A-A.

The date indicator 18 is an annular rotary disk and rotatable about the same rotation axis as that of the hour hand 16 and the minute hand 17.

The top face of the date indicator 18 has date signs indicating the dates of one through thirty-one (first information items) arranged every 11.25 degrees on the same circumference.

A disk-shaped information display plate 19 having a smaller radius than that of the date indicator 18 is provided above and substantially parallel to the indicator 18.

The outer circumference of the information display plate 19 and the outer circumference of the date indicator 18 stand in one position at a three-o'clock position.

The top face of the information display plate 19 has three signs of "TEL", "MAIL" and "LINK" (information display portion or second information display portion) arranged every 90 degrees.

The information display plate 19 also has a small transparent window 191 at the opposite side, i.e., at 180 degrees from "MAIL" (predetermined part). The window 191 allows one of the signs on the underlying date indicator 18 to appear therethrough.

Note that the information display plate 19 may also provide an opening instead of the small transparent window 191 at the same position so as to allow for direct view of the underlying signs on the date indicator 18.

Alternatively, the information display plate 19 may be made of a transparent member to allow the underlying date signs on the date indicator 18 to be viewed from above through the transparent member within an angular range that does not include "TEL", "MAIL" and "LINK".

A drive wheel connection gear 211 of the gear train mechanism 21 is rotated by a predetermined angle in response to the step drive of the step motor 23, and the information display plate 19 rotates by the same angle in conjunction with the drive wheel connection gear 211.

The rotation of the drive wheel connection gear 211 only within a predetermined angular range is transmitted to a date indicator driving wheel 214 using a pin 212 and a slot 213 of a Geneva drive, which allows the date indicator driving wheel 214 to engage with an internal gear of the date indicator 18, thereby rotating the date indicator 18.

In other words, a 360-degree rotation of the information display plate 19 caused by the drive wheel connection gear 211 inside a housing 51 results in rotation of the date indicator 18 by 11.25 degrees.

Figure 5:
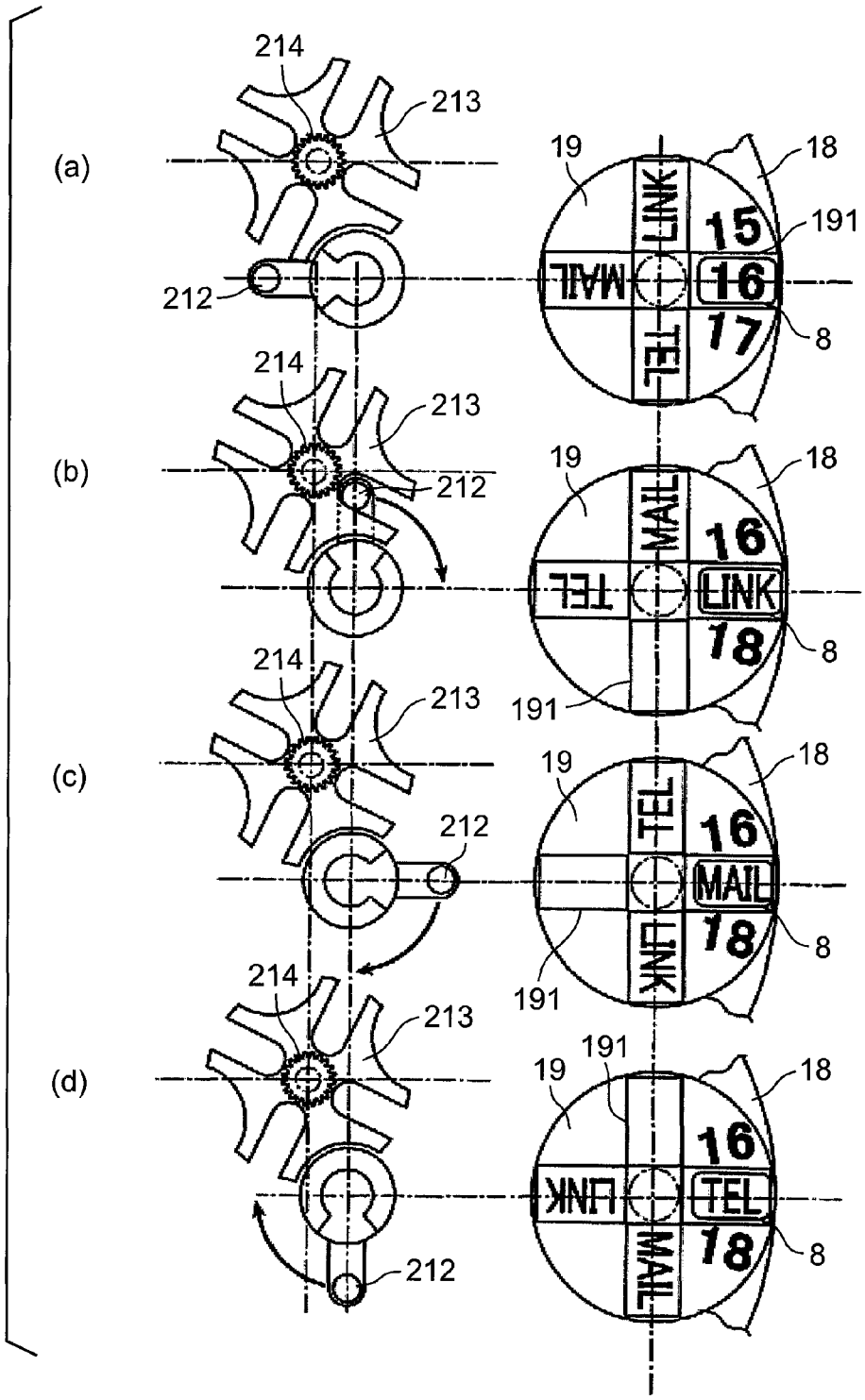
FIG. 5 illustrates a method of displaying information using the date indicator and the information display plate.

FIG. 5 illustrates actual display of information by the date indicator 18 and the information display plate 19.

In a state where the small transparent window 191 of the information display plate 19 lies just under the aperture 8, when the pin 212 which rotates with the drive wheel connection gear 211 is received in the slot 213 which rotates with the date indicator driving wheel 214 (i.e., driven wheel), the rotation of the pin 212 is transmitted to the slot 213.

As a result, during a 90-degree rotation of the drive wheel connection gear 211, the date indicator driving wheel 214 is rotated in conjunction with the drive wheel connection gear 211, which in turn rotates the date indicator 18.

This rotation changes the currently displayed date to the next date (FIG. 5(*a*) and FIG. 5(*b*)).

Furthermore, this rotation causes the information display plate 19 to rotate by 90 degrees (i.e., a predetermined part of the rotation of the second information display plate) in conjunction with the drive wheel connection gear 211, leading to appearance of "LINK" covering the date on the date indicator 18, through the aperture 8.

When the date indicator driving wheel 214 rotates by 90 degrees, the pin 212 leaves the slot 213.

The date indicator driving wheel 214 does not rotate during additional 270-degree rotation of the drive wheel connection gear 211 (FIG. 5(*b*), FIG. 5(*c*) and FIG. 5(*d*)).

Thus, this 270-degree rotation of the drive wheel connection gear 211 allows solely the information display plate 19 to rotate (i.e., the rotation except for the predetermined part of the rotation of the second information display plate).

Rotation by 90 degrees from the state of FIG. 5(*b*) exposes "MAIL" (FIG. 5(*c*)).

Rotation by 180 degrees from the state of FIG. 5(*b*) exposes "TEL" (FIG. 5(*d*)).

Rotation by 270 degrees from the state of FIG. 5(*b*) makes one of the date signs on the date indicator 18 appear through the small transparent window 191.

The date indicator 18 is not rotated during 270-degree rotation of the drive wheel connection gear 211 in the reverse direction (counterclockwise as viewed from above) from the state where the small transparent window 191 is exposed for sequentially exposing the signs "TEL", "MAIL" and "LINK" in this order through the aperture 8.

Accordingly, at the time of regular date change, the analog electronic timepiece 10 rotates the drive wheel connection gear 211 by 360 degrees in the forward direction (clockwise as viewed from above) to display the next date through the aperture 8 and the small transparent window 191.

The drive wheel connection gear 211 is then rotated in the reverse direction from this position as needed within a maximum range of 270 degrees, and thereby any one of the date and the signs of "TEL", "MAIL" and "LINK" associated with other information items can be exposed as appropriate without shifting the date indicator 18.

A display operation in the analog electronic timepiece 10 according to the present embodiment will now be described.

Figure 6:
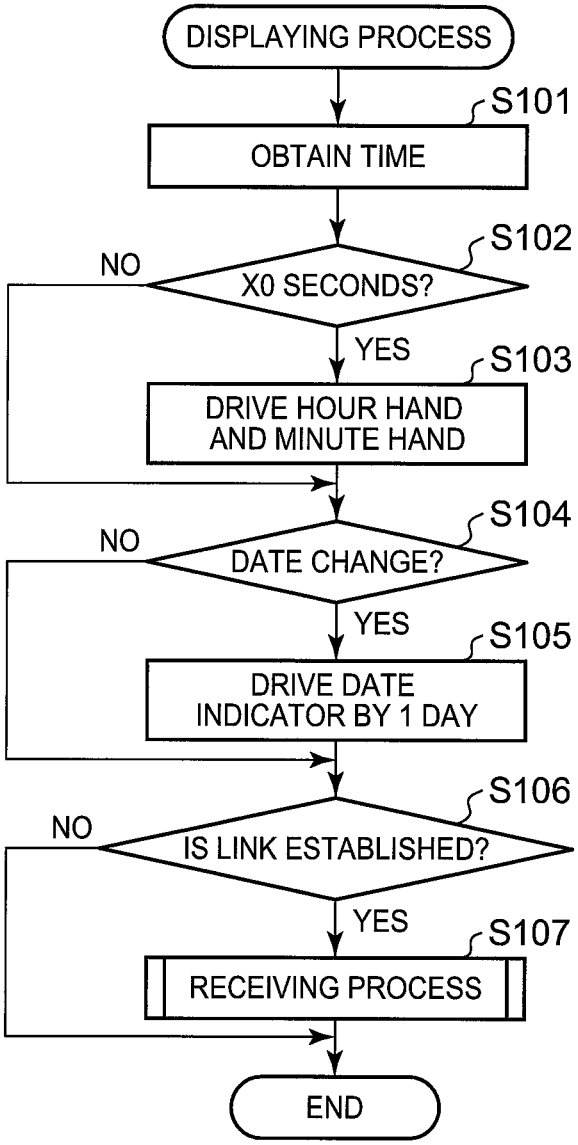
FIG. 6 is a flow chart illustrating the control procedure of a displaying process to be executed by the analog electronic timepiece.

FIG. 6 is a flow chart illustrating the control procedure of a displaying process to be executed by the CPU 11 of the analog electronic timepiece 10.

The displaying process is invoked and executed in response to an input clock signal of 1 Hz at the time of every change of the second value.

In the displaying process, the CPU 11 first executes a process to obtain the time (step S101).

The CPU 11 obtains current time data from the time calculating circuit 15 which calculates the current time on the basis of a clock signal.

The CPU 11 then determines whether the current time is "X0 seconds", namely, the first digit of the second value is "0" (step S102).

If determining that the first digit of the second value is "0", the CPU 11 sends a control signal to the step motor driving circuit 24, which then operates the step motor 22 to rotate the hour hand 16 and the minute hand 17 (step S103).

The process of the CPU 11 then goes on to step S104.

If the CPU 11 determines that the first digit of the second value is not "0", the process of the CPU 11 directly goes on to step S104.

In step S104, the CPU 11 determines whether it is the timing of changing the displayed date.

If determining that it is the timing of changing the displayed date, the CPU 11 sends a control signal to the step motor driving circuit 24, which then operates the step motor 23 to rotate the date indicator 18 and the information display plate 19, thereby displaying the next date (step S105).

The process of the CPU 11 then goes on to step S106.

If the CPU 11 determines that it is not the timing of changing the displayed date, the process of the CPU 11 directly goes on to step S106.

In step S106, the CPU 11 determines whether a Bluetooth communication link with the smartphone 40 is established.

If determining that the communication link is established, the CPU 11 executes a receiving process (step S107) as described below, and then finishes the displaying process.

If determining that the communication link is not established, the CPU 11 finishes the displaying process.

Figure 7:
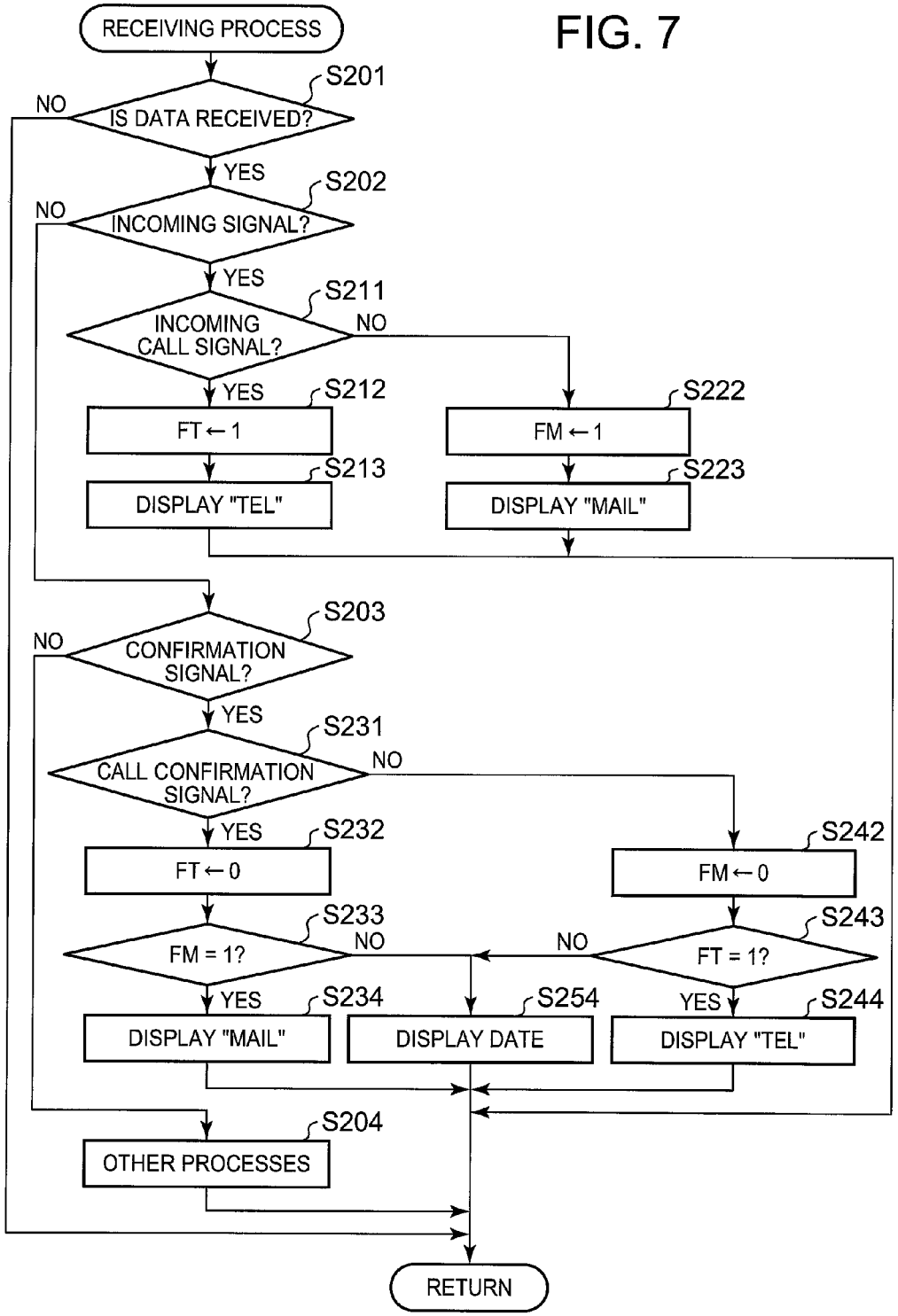
FIG. 7 is a flow chart illustrating the control procedure of a receiving process invoked in the displaying process.

FIG. 7 is a flow chart illustrating the control procedure of the receiving process invoked in the displaying process.

In the receiving process, the CPU 11 first determines whether data is received (step S201).

If determining that data is not received, the CPU 11 finishes the receiving process and returns the process to the displaying process.

If determining that data is received, the CPU 11 further determines whether the received data is an incoming signal to the smartphone 40 (step S202).

If determining that the received data is an incoming signal, the CPU 11 further determines whether the incoming signal is an incoming call signal (step S211).

If determining that the incoming signal is an incoming call signal, the CPU 11 sets the flag FT to "1" (step S212).

In addition, the CPU 11 outputs a control signal to the step motor driving circuit 24 to rotate the information display plate 19 such that "TEL" on the information display plate 19 appears through the aperture 8 (step S213).

The CPU 11 then finishes the receiving process.

The process of the CPU 11 then returns to the displaying process.

If it is determined that the received data is not an incoming call signal in the determination step S211, the received data is an incoming e-mail signal; thus, the CPU 11 sets the flag FM to "1" (step S222).

The CPU 11 outputs a control signal to the step motor driving circuit 24 to rotate the information display plate 19 such that "MAIL" on the information display plate 19 appears through the aperture 8 (step S223).

The CPU 11 then finishes the receiving process.

The process of the CPU 11 then returns to the displaying process.

If determining that the received data is not an incoming signal in the determination step S202, the CPU 11 further determines whether the received data is a confirmation signal (step S203).

If determining that the received data is a confirmation signal, the CPU 11 further determines whether the confirmation signal is a call confirmation signal (step S231).

If determining that the confirmation signal is a call confirmation signal, the CPU 11 sets the flag FT to "0" (step S232).

The CPU 11 then determines whether the flag FM is "1" (step S233).

If determining that the flag FM is "1", the CPU 11 outputs a control signal to the step motor driving circuit 24, which then operates the step motor 23 such that "MAIL" on the information display plate 19 appears through the aperture 8 (step S234).

The CPU 11 then finishes the receiving process and returns the process to the displaying process.

If determining that the flag FM is not "1" in the determination step S233, the CPU 11 outputs a control signal to the step motor driving circuit 24, which then operates the step motor 23 such that the small transparent window 191 of the information display plate 19 lies just under the aperture 8, thereby causing a date sign on the date indicator 18 to appear through the aperture 8 (step S254).

The CPU 11 then finishes the receiving process and returns the process to the displaying process.

If it is determined that the confirmation signal is not a call confirmation signal in the determination step S231, the confirmation signal is an e-mail confirmation signal; thus, the CPU 11 sets the flag FM to "0" (step S242).

The CPU 11 then determines whether the flag FT is "1" (step S243).

If the CPU 11 determines that the flag FT is not "1", the process of the CPU 11 goes on to step S254.

If determining that the flag FT is "1", the CPU 11 outputs a control signal to the step motor driving circuit 24, which then operates the step motor 23 to rotate the information display plate 19 such that "TEL" on the information display plate 19 appears through the aperture 8 (step S244).

The CPU 11 then finishes the receiving process and returns the process to the displaying process.

If determining that the received data is not a confirmation signal in the determination step S203, the CPU 11 executes other processes (step S204), finishes the receiving process, and returns the process to the displaying process.

Figure 8:
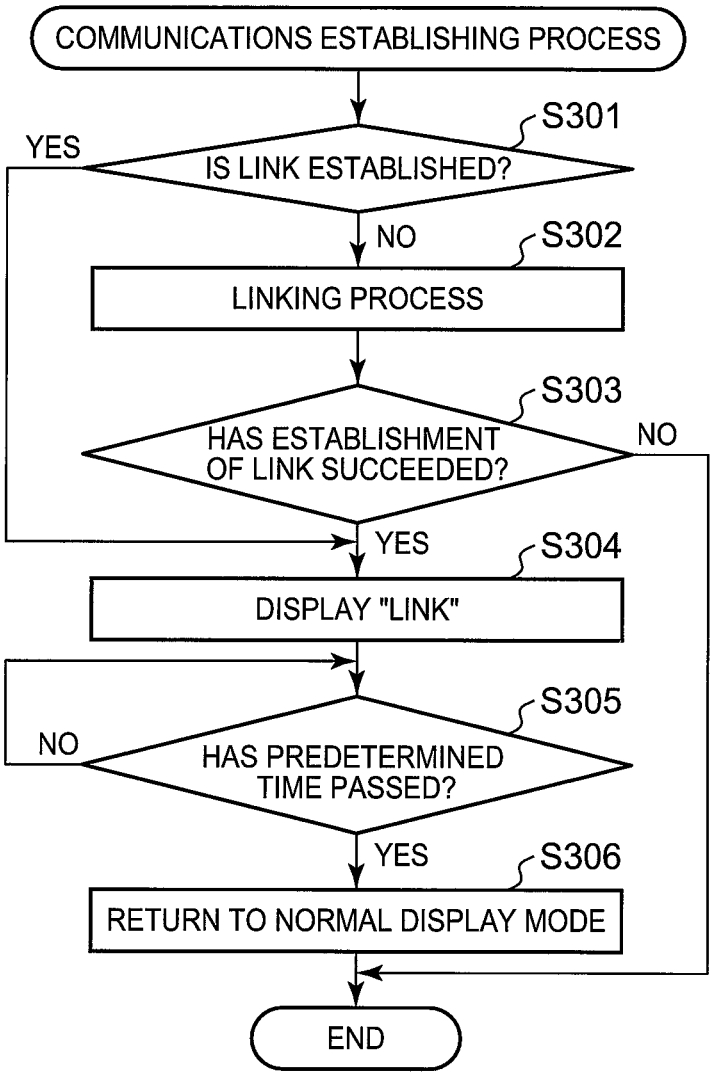
FIG. 8 is a flow chart illustrating the control procedure of a process of establishing communications.

FIG. 8 illustrates a flow chart of the control procedure of establishing communications to be executed by the CPU 11.

This communications establishing process is to provide a communication link between the analog electronic timepiece 10 and the smartphone 40 for execution of the receiving process every second in the above displaying process.

This communications establishing process starts in response to, for example, the reception of a request for establishing communications transmitted from the smartphone 40 upon an operational input thereto, or starts upon a detection of a preset time to execute this process.

Alternatively, a predetermined user operation on the crown C may start the process.

In the communications establishing process, the CPU 11 first determines whether a communication link has already been established (step S301).

If the CPU 11 determines that a communication link has already been established, the process of the CPU 11 goes on to step S304.

If determining that a communication link has not been established, the CPU 11 executes a process for linking with the smartphone 40 (step S302).

This linking process may be executed by a well-known method in accordance with a Bluetooth communication protocol.

If a link is not established at this time, the CPU 11 repeats the linking process for a preset time period. If a link remains unestablished during the period, the CPU 11 finishes the linking process.

The CPU 11 determines whether the establishment of the communication link with the smartphone 40 has succeeded (step S303).

If determining that the establishment of the communication link has failed, the CPU 11 finishes the communications establishing process.

If the CPU 11 determines that the establishment of the communication link has succeeded, the process of the CPU 11 goes on to step S304.

In step S304, the CPU 11 sends a control signal to the step motor driving circuit 24, which then operates the step motor 23 to rotate the information display plate 19 such that "LINK" on the information display plate 19 appears through the aperture 8.

The CPU 11 then measures the duration of "LINK" being displayed.

The CPU 11 determines whether the duration of "LINK" reaches a predetermined time (step S305).

The CPU 11 repeats step S305 until it is determined that the predetermined time has passed.

After the predetermined time passes, the CPU 11 sends a control signal to the step motor driving circuit 24, which then operates the step motor 23 to return to the normal display mode (step S306).

That is, the CPU 11 allows the small transparent window 191 of the information display plate 19 to lie just under the aperture 8, thereby displaying the current-date sign on the date indicator 18.

The CPU 11 then finishes the communications establishing process.

As described above, the analog electronic timepiece 10 according to the embodiment of the present invention includes the dial plate 7 having the aperture 8; the rotatable date indicator 18 provided under the dial plate 7 and having the date signs, which are selectively displayed through the aperture 8; the information display plate 19 provided between the dial plate 7 and the date indicator 18 and having signs of "TEL", "MAIL" and "LINK" on its top surface, the signs indicating information different from date information; and the step motor driving circuit 24 which outputs a drive pulse to the step motor 23, which then operates the gear train mechanism 21 to rotate the information display plate 19 such that one of the small transparent window 191 and the signs of "TEL", "MAIL" and "LINK" lies just under the aperture 8.

Thus, the analog electronic timepiece 10 can readily display any one of "TEL", "MAIL" and "LINK" by rotating the information display plate 19 when there is information to be output and the sign associated with the information is to be displayed.

The analog electronic timepiece 10 can also display a date sign through the small transparent window 191 and the aperture 8 when there is no information to be output.

In this manner, the date information item and the other information items are displayed using the date indicator 18 and the information display plate 19, respectively; hence, a displayed information item can be switched from one information item to another without the positional reset of the one information item.

Also, only a single sign is displayed through the aperture 8, which can prevent the user from being confused by multiple signs.

Furthermore, the date information item and the other information items can be displayed and the displayed item can be switched among these information items without positional changes of the hands 16 and 17 to be used for indicating the time. These information items are less frequently checked by the user than the time information; hence, this can overcome the disadvantage of hindering the user from checking the time while one of the information items is being displayed.

Moreover, the analog electronic timepiece 10 may adopt a conventional dial plate configuration intended to display only dates using a date indicator; hence, marks and signs associated with multiple information items are not needed on the dial plate, which can increase design flexibility.

Additionally, the date information item and the other information items are displayed using the date indicator 18 and the information display plate 19, respectively; hence, the display of the date sign, which changes at regular intervals, is not influenced by the information displayed at irregular intervals. This can eliminate the excess operations of the date indicator 18.

In particular, the number of operational steps of a rotary disk, such as the date indicator 18 having many steps for a full circle, can be significantly reduced. This leads to a reduction in power consumption and to quick display of information.

In addition, since the information display plate 19 is a rotatable disk and has signs on its top surface, the information display plate 19 can be readily operated with a gear train mechanism.

Furthermore, a Geneva drive and a partially toothed gear can rotate the date indicator 18 in partially conjunction with the rotation of the information display plate 19; hence, a single step motor can properly switch among multiple information items without a heavy burden on the rotation of the date indicator 18.

Thus, an increase in weight and size caused by an additional step motor can be avoided.

In addition, since the information display plate 19 rotates without engaging with the date indicator 18 for a predetermined part of rotation of the information display plate 19, rotating the information display plate 19 does not involve the torque required to additionally rotate the date indicator 18 at the time of displaying an information item. As a result, a displayed information item can be readily switched among information items without increase in the width of and the voltage of a pulse output from the step motor driving circuit 24.

Moreover, the Bluetooth communication function allows signals about the presence of information to be received substantially in real time from an external device such as a connected smartphone 40, and an information item corresponding to the information can be displayed using the information display plate 19 when the information is present. As a result, the user can readily detect the presence of information even if the smartphone 40 cannot be held in hand or kept in plain view.

Additionally, since such a function is included in an analog electronic timepiece, in particular, a user wearable thing such as a wristwatch, information other than time information can be obtained more quickly and more reliably without compromising the function of the timepiece.

In particular, the user can obtain incoming call information and incoming e-mail information quickly. Thus, the user can make a response without fail when a quick response is required.

[First Modification]

A first modification of the analog electronic timepiece 10 according to the present embodiment will now be described.

Figure 9A:
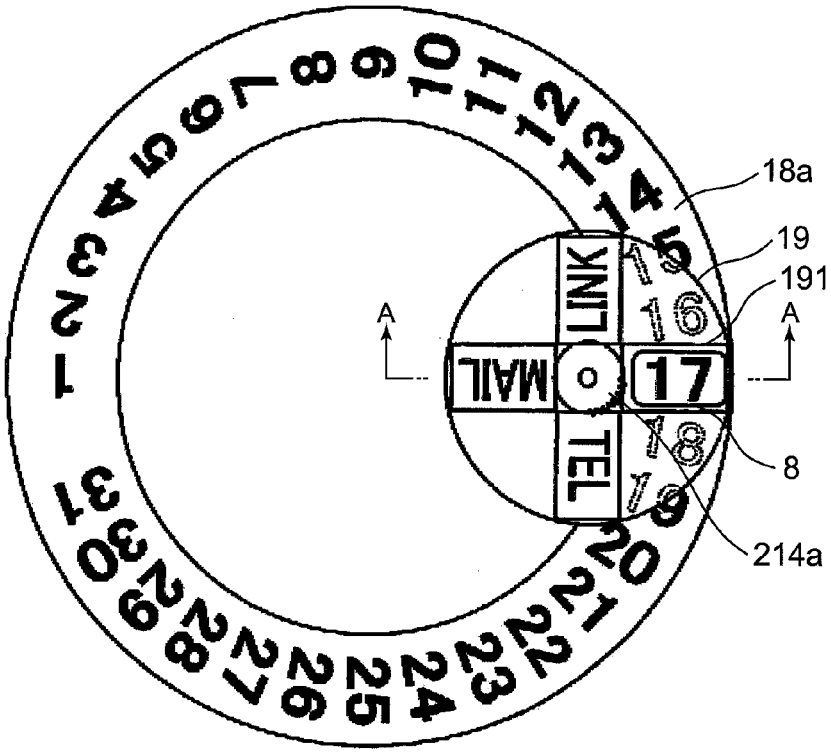
FIGS. 9A and 9B illustrate the configuration of a date indicator and an information display plate in an analog electronic timepiece according to a first modification.
Figure 9B:
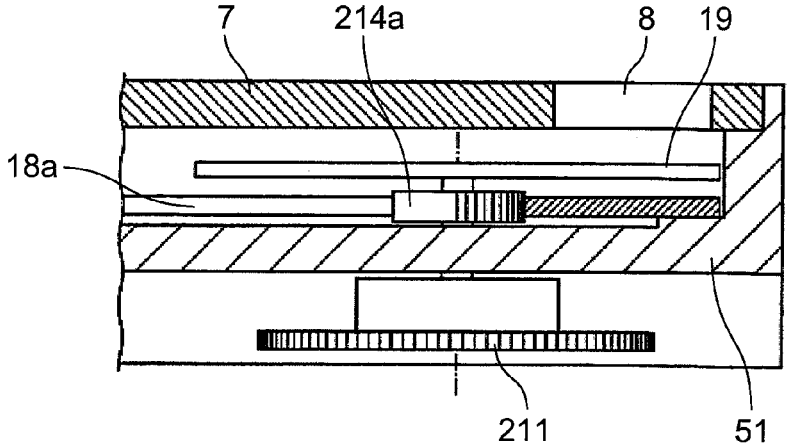

FIGS. 9A and 9B illustrate a date indicator 18*a* and an information display plate 19 in an analog electronic timepiece 10 of the first modification.

The analog electronic timepiece 10 of the first modification does not use a Geneva drive. Instead, a date indicator driving wheel 214*a*, which rotates along with a drive wheel connection gear 211 and the information display plate 19, rotates in partial mesh with an internal gear of the date indicator 18*a* directly.

The other components are identical to those of the analog electronic timepiece 10 in the above-described embodiment; hence, the same reference numerals are assigned and a redundant description thereof is omitted.

The date indicator driving wheel 214*a* is a partially toothed gear having teeth only on a range of 90 degrees at a predetermined portion. The other range of 270 degrees does not come into contact with the internal gear of the date indicator 18*a*. That is, the portion of the 270-degree range does not rotate the date indicator 18*a*.

Accordingly, the internal gear of the date indicator 18*a* may have partial teeth provided only on a range that engages with the date indicator driving wheel 214*a*.

Figure 10:
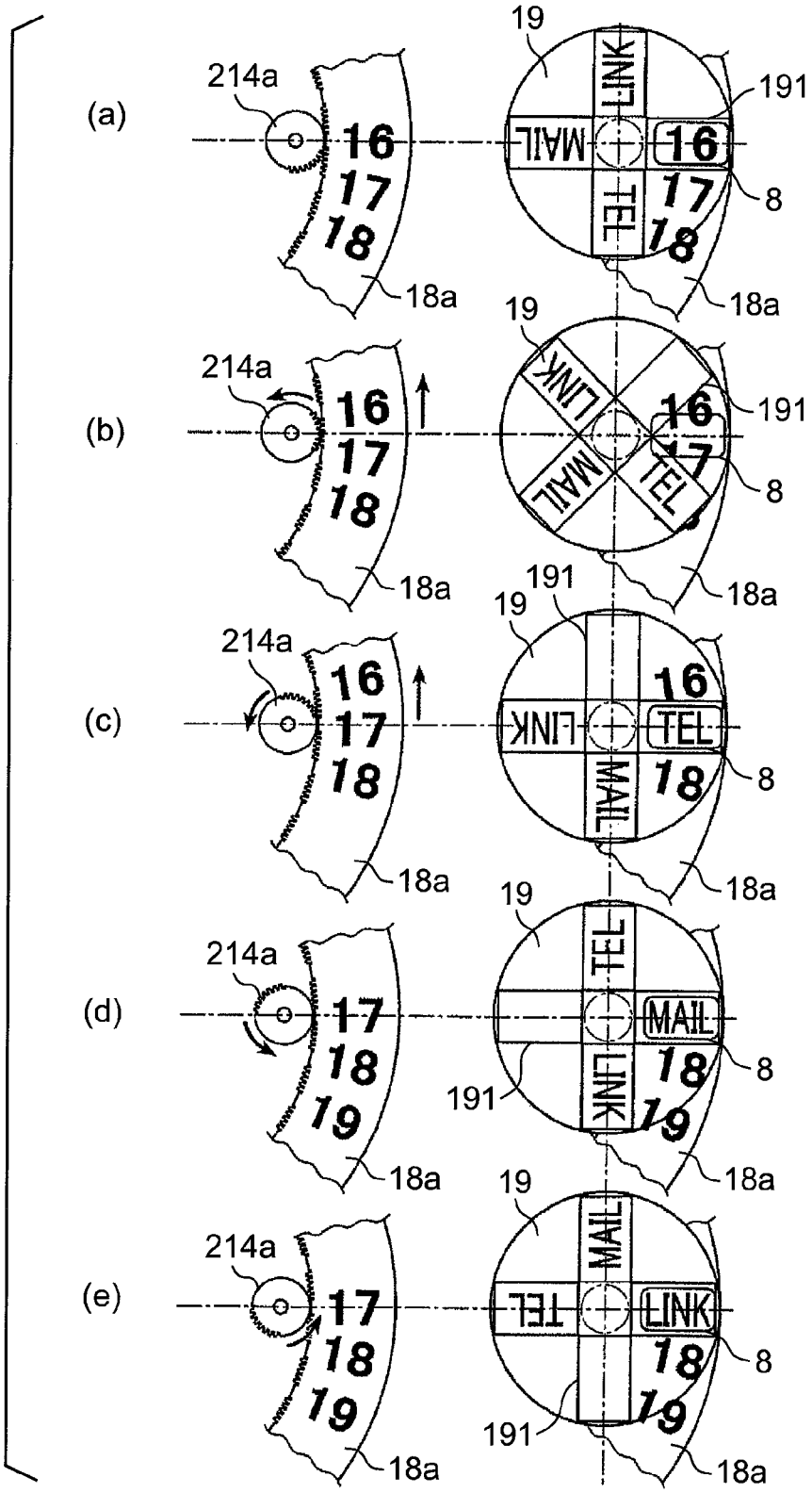
FIG. 10 illustrates a method of displaying information using the date indicator and the information display plate in the analog electronic timepiece according to the first modification.

FIG. 10 illustrates a method of displaying information using the date indicator 18*a* and the information display plate 19 in the analog electronic timepiece 10 according to the first modification.

Like the date indicator 18 and the information display plate 19 of the above-described embodiment, when a drive wheel connection gear 211 is rotated in the reverse direction from a state where a small transparent window 191 of the information display plate 19 lies just under an aperture 8 (FIG. 10(*a*)), the information display plate 19 is rotated and the date indicator driving wheel 214*a* engages with the internal gear of the date indicator 18*a*, which rotates (shifts) date signs (FIG. 10(*b*)).

Then, 90-degree rotation of the drive wheel connection gear 211 allows the date indicator driving wheel 214*a* and the date indicator 18*a* to disengage.

At this time, the next date sign on the date indicator 18*a* lies just under the aperture 8 and the sign of "TEL" on the information display plate 19 appears through the aperture 8, as illustrated in FIG. 10(*c*).

The drive wheel connection gear 211 alone further rotates from this state by a maximum angle of 270 degrees in the reverse direction. The first 90-degree rotation of the drive wheel connection gear 211 allows the sign of "MAIL" to appear through the aperture 8, as illustrated in FIG. 10(*d*), and the next 90-degree rotation (180 degrees in total) allows the sign of "LINK" to appear through the aperture 8, as illustrated in FIG. 10(*e*).

Then, further 90-degree rotation (270 degrees in total) of the drive wheel connection gear 211 allows the small transparent window 191 to overlap with the aperture 8, and one of the date signs on the date indicator 18*a* appears through the small transparent window 191 and the aperture 8.

At the time of date change, a CPU 11 rotates the drive wheel connection gear 211 and the information display plate 19 by 360 degrees in the reverse direction to display the next date through the small transparent window 191 and the aperture 8.

The CPU 11 then rotates the drive wheel connection gear 211 and the information display plate 19 as needed within a range of 270 degrees in the forward direction, and thereby any one of the date and the signs of "TEL", "MAIL" and "LINK" associated with other information items can be exposed as appropriate without shifting the date indicator 18*a*.

In summary, according to the first modification of the analog electronic timepiece 10 of the above embodiment, switching between the state where the date indicator 18*a* and the information display plate 19 rotate in meshing engagement with each other and the state where the date indicator 18*a* and the information display plate 19 are disengaged from each other can be achieved with a simpler structure without a Geneva drive. As a result, an increase in the weight and size of the analog electronic timepiece 10 can be avoided.

[Second Modification]

An analog electronic timepiece 10 of a second modification will now be described.

Figure 11:
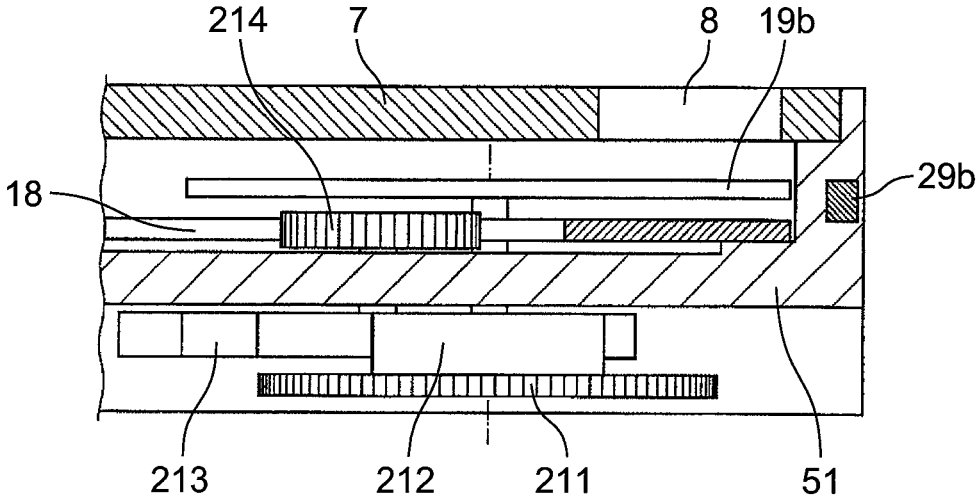
FIG. 11 illustrates the configuration of a date indicator and an information display plate in an analog electronic timepiece according to a second modification.

FIG. 11 is a schematic side view of the configuration of a date indicator 18 and an information display plate 19*b* in the analog electronic timepiece 10 of the second modification, shown in the same position and orientation as those in FIG. 4B.

The analog electronic timepiece 10 according to the second modification is identical to the analog electronic timepiece 10 of the above-described embodiment except for the additional information display plate 19*b* and an additional LED 29*b* (illuminator) provided at one side of the information display plate 19*b*; hence, the same reference numerals are assigned to the common components and a redundant description thereof is omitted.

The information display plate 19*b* is a light-guide plate.

Light incident on a side of the information display plate 19*b* is almost evenly reflected by the undersurface and is output from the top surface.

When any one of the signs of "TEL", "MAIL" and "LINK" on the information display plate 19*b* appears through an aperture 8, a CPU 11 turns on the LED 29*b* so that light enters the information display plate 19*b* through its side.

As a result, when any one of the signs on the information display plate 19*b* appears, the light is emitted from the aperture 8 at the same time.

The light-emitting duration time of the LED 29*b* can be set as appropriate.

Alternatively, the LED 29*b* may blink or may be driven by pulses at predetermined intervals.

In summary, according to the second modification of the analog electronic timepiece 10 in the above present embodiment, the light-guide plate is used as the information display plate 19*b*, which can reflect (emit) light for notification of one of the information items; hence, the user can more reliably detect the information output.

Note that the above embodiment and its modifications of the present invention may be modified in various ways.

For example, although the date indicator 18 and the information display plate 19 rotate in conjunction with each other in the above-described embodiment, this mechanism may be appropriately modified.

Each of the date indicator 18 and the information display plate 19 may be rotated individually by a separate motor.

Furthermore, although the analog electronic timepiece in the above-described embodiment displays the information items using the two rotary disks, this technique may be appropriately modified.

For example, a displayed information item may be switched while reeling a belt which has multiple signs thereon by a motor.

Although the analog electronic timepiece in the above-described embodiment displays a date and incoming information received from an external device at the same position, any other information item may also be displayed.

For example, the analog electronic timepiece may display a day of the week instead of a date, or a notification based on the schedule managed by the smartphone 40 may be displayed instead of an incoming call or e-mail.

Moreover, an information display device having such a configuration should not be limited to a timepiece; hence, hands for indicating information are not essential.

Thus, this information display device can readily employ various designs.

Although the information to be displayed is received from the smartphone 40 through Bluetooth communications in the above-described embodiment, communications can be established with various other external devices such as mobile phones and mobile computers.

Furthermore, an information item to be displayed is not limited to the information obtained from an external device.

Displayed information items may be associated with other functions included in the analog electronic timepiece itself, such as alarm setting and mode setting.

In addition, the technique may be applied to a decoration function without the necessity of a control operation, such as the function where a design or a pattern preliminarily stored in the analog electronic timepiece is displayed at a predetermined time every day.

In the second modification, the light-guide plate allows the information display plate 19*b* itself to emit light using the light from the LED 29*b*. Alternatively, the information display plate 19*b* may be directly illuminated with light emitted by the LED 29*b* from above.

Furthermore, not single information display plate 19 but multiple information display plates 19 may be provided above the date indicator 18.

The date indicator 18 of the above-described embodiment rotates in conjunction with the rotation of the information display plate 19 while the plate 19 is rotating from the state where the small transparent window 191 lies just under the aperture 8 to the state where "TEL" or "LINK" lies just under the aperture 8; however, any other configuration may be used.

For example, the date indicator 18 may rotate in conjunction with the rotation of the information display plate 19 while the information display plate 19 is rotating from the state where "TEL" or "LINK" lies just under the aperture 8 to the state where the small transparent window 191 lies just under the aperture 8.

Moreover, the specific configurations, arrangements, values, and orders of the processes in the above embodiment may be modified as appropriate without deviating from the gist of the present invention.

Although some embodiments of the present invention have been described, they should not be construed as limitations on the scope of the present invention, which includes the scope of the invention stated in the following claims and equivalents thereto.

The entire disclosure of Japanese Patent Application No. 2012-169209 filed on Jul. 31, 2012 including description, claims, drawings, and abstract is incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An information display device comprising:

a dial plate having a display window;

a rotatable date display plate provided under the dial plate, the date display plate having a plurality of dates to be selectively displayed through the display window;

an information display plate provided between the dial plate and the date display plate, the information display plate including an information display portion having a non-date information item on a top surface thereof, the non-date information item being different from the dates; and an information display plate driver capable of moving the information display plate to any one of a predetermined first position and a second position, wherein, when the information display plate is in the first position, the information display portion does not lie just under the display window and a date of the dates in a position corresponding to the display window is displayed through the display window; and when the information display plate is in the second position, the information display portion is in a position corresponding to the display window.

2. The information display device according to claim 1, wherein the information display plate is rotatable; and wherein the date can be displayed through a predetermined part of the information display plate and through the display window.

3. The information display device according to claim 2, further comprising an information display plate drive controller which controls the information display plate driver to operate according to information to be output, wherein the date display plate rotates in conjunction with a rotation of the information display plate;

wherein the information display plate drive controller rotates the date display plate along with the information display plate to change the date to be displayed; and wherein the information display plate drive controller rotates the information display plate while the date display plate is standing still to switch an information item to be displayed, so that one of the date and the non-date information item according to the information to be output is displayed through the display window.

4. The information display device according to claim 3, wherein the date display plate rotates in conjunction with a predetermined part of the rotation of the information display plate; and wherein the information display plate drive controller rotates solely the information display plate except for the predetermined part of the rotation of the information display plate to switch the information item to be displayed through the display window.

5. The information display device according to claim 1, further comprising a wireless communication unit which performs wireless communications with an external device, wherein the non-date information item corresponds to information received by the wireless communication unit from the external device.

6. The information display device according to claim 1, further comprising:

an illuminator which illuminates the information display plate; and an illumination controller which controls the illuminator to illuminate the information display plate while the information display portion is in a position corresponding to the display window.

7. An analog electronic timepiece comprising:

the information display device according to claim 1;

a time calculating unit which calculates a time; and a plurality of rotatable hands provided on the dial plate, the hands pointing to the time calculated by the time calculating unit.

* * * * *